US005597649A

United States Patent [19]

Sandor et al.

[11] Patent Number: 5,597,649

[45] Date of Patent: Jan. 28, 1997

[54] COMPOSITE YARNS HAVING HIGH CUT RESISTANCE FOR SEVERE SERVICE

[75] Inventors: Robert B. Sandor, South Orange; Herman L. LaNieve, III, Warren; Robert E. Roschen, Wall Township, all of N.J.

[73] Assignee: Hoechst Celanese Corp., Somerville, N.J.

[21] Appl. No.: 558,456

[22] Filed: Nov. 16, 1995

[51] Int. Cl.[6] ..... D02G 3/00

[52] U.S. Cl. ..... 428/370; 428/372; 428/377; 57/207; 57/210; 57/238; 57/244

[58] Field of Search ..... 428/377, 364, 428/370, 372; 57/251, 249, 210, 238, 244, 207

[56] References Cited

U.S. PATENT DOCUMENTS 4,864,852 9/1989 Boone .

5,119,512 6/1992 Dunbar et al. .

FOREIGN PATENT DOCUMENTS

0599231A1 11/1993 European Pat. Off. .

*Primary Examiner*—Newton Edwards

*Attorney, Agent, or Firm*—James L. McGinnis

[57] ABSTRACT

Composite yarns having exceptional cut resistance are made by combining at least two different kinds of fiber, as follows: (a) a high modulus fiber having a modulus greater than about 200 gpd as measured by ASTM Test Method D-3822; and (b) a particle-filled fiber, which is made from a semi-crystalline polymer, such as poly(ethylene terephthalate), and hard particles having a Mohs Hardness Value greater than about 3.

11 Claims, No Drawings

COMPOSITE YARNS HAVING HIGH CUT RESISTANCE FOR SEVERE SERVICE

This application is related to commonly assigned U.S. application Ser. No. 08/243,344, filed May 18, 1994, still pending; commonly assigned U.S. application Ser. Nos. 08/484,544 and 08/481,020, both still pending, both of which are divisionals of U.S. application Ser. No. 08/243,344; and commonly assigned U.S. application Ser. No. 08/482,207, filed Jun. 7, 1995, still pending.

BACKGROUND OF THE INVENTION

There is a continuing need for fabrics that resist cutting and chopping with knives and other tools having sharp edges. Such fabrics are particularly useful for making protective clothing, such as gloves, for use in such activities as meat cutting and the handling of metal and glass sheets that have rough edges.

It has been found that certain kinds of fibers and yarns can be woven or knit to yield fabrics that are resistant to cutting. Yarns that have high cut resistance generally contain fibers having high tensile strength and high modulus, such as aramid fibers, thermotropic liquid crystalline polymer fibers, and extended chain polyethylene fibers.

It has also been reported in U.S. Pat. No. 5,119,512 that composite yarns containing "inherently cut resistant" high strength fibers, such as extended chain polyethylene, and "hard" non-metallic fibers, such as fiberglass, have an enhanced level of resistance to cutting. This patent also indicates at column 6, lines 24–35, that the hard fiber can optionally be non-continuous, non-uniform, or chopped, that it can alternatively be coated onto an organic fiber, or that it can be in the form of ceramic particles or fibrils impregnated into an organic fiber. Detailed information is not provided.

Copending U.S. application Ser. Nos. 243,344; 484,544; 481,020; and 482,207 all teach that thermoplastic fibers such as poly(ethylene terephthalate) and thermotropic liquid crystalline polymers can be made significantly more cut resistant by including hard particles in the fibers, and that a fiber made from a polymer such as poly(ethylene terephthalate) filled with hard particles may be as cut resistant as the high modulus fibers.

SUMMARY OF THE INVENTION

Composite yarns having exceptional cut resistance comprise at least two different kinds of fiber in the yarn:

(1) a high modulus fiber, having a modulus of greater than about 200 gpd as measured by ASTM Test Method D3822; and (2) a particle-filled fiber, where the fiber is made from a semi-crystalline polymer and hard particles having a Mohs Hardness Value greater than about 3. The hard particles have an average particle size in the range of about 0.25 to about 6 microns. The particles are included in the fiber at a level up to about 10% on a volume basis. Fabrics made from these composite yarns have a higher cut resistance than would be expected based on the performance of composites in which continuous lengths of fiber made from a hard material are used. They also are much more comfortable than fabrics made from composites of high modulus fibers and continuous lengths of hard fiber because they have a softer feel and are less stiff and less dense. The composite yarns are made by combining at least two yarns, each of which comprises one of the kinds of fiber.

DETAILED DESCRIPTION OF THE INVENTION

"Composite yarn" is defined in "Fairchild's Dictionary of Textiles," Seventh Edition, Fairchild Publications, 1996, to mean "a yarn comprised of two or more staple fiber and/or filament components that are combined in the spinning process." The term "composite yarn" is also used more generally by practitioners in the art to include yarns that are made by wrapping one yarn around another. High modulus fibers that are used in the composite yarns generally have a higher resistance to cutting than fibers made from conventional thermoplastic polymers. The modulus of the high modulus fibers is greater than about 200 gpd, and preferably is greater than about 300 gpd, and the tensile strength is normally greater than about 10 gpd; both of these measurements are made according to ASTM Test Method D-3822.

Examples of high modulus fibers include aramid fibers, extended chain polyolefin fibers, thermotropic liquid crystalline fibers, high strength polyvinyl alcohol, and poly(ethylene naphthalate). Aramids are all-aromatic polyamides with approximately linear molecular structures. Examples include DuPont's KEVLAR® fiber, which is poly(phenylene terephthalamide) and is processed from a lyotropic solution. Another example is TREVAR®, a melt processable aramid from Hoechst AG. Extended chain polyolefin fibers are very high molecular weight polyolefins which are processed in such a way that the polymer chains are relatively aligned, such as by gel spinning. Extended chain polyethylene fibers are available as CERTRAN® fiber from Hoechst Celanese Corporation and SPECTRA® fiber from Allied-Signal Corporation. Extended chain polypropylene is also known. Thermotropic liquid crystalline polymers comprise linear polyester and poly(esteramide) polymer chains which are derived from linear or bent bifunctional aromatic groups, such as 4-hydroxybenzoic acid, 6-hydroxy-2-naphthoic acid, terephthalic acid, isophthalic acid, 2,6-naphthalenedicarboxylic acid, 4,4'-biphenyldicarboxylic acid, 1,4-hydroquinone, 2,6-dihydroxynaphthalene, 4,4'-dihydroxybiphenyl, resorcinol, 4-aminobenzoic acid and 4-aminophenol. They may also include other bifunctional monomers in the polymer chain, such as ethylene glycol. These polymers form liquid crystalline melts when they are heated above their melting temperatures. Liquid crystalline polymer fibers are supplied by Hoechst Celanese Corporation under the VECTRAN® trademark. The preferred high modulus fibers for these yarns comprise extended chain polyethylene, aramids, and/or thermotropic liquid crystalline polymers.

The semi-crystalline polymers that are used in making the particle-filled fibers are preferably melt-processable. This means that they melt in a temperature range that makes it possible to spin the polymer into fibers in the melt phase without significant decomposition. The preferred method of making the fiber is by melt spinning. Polymers that cannot be processed in the melt, such as cellulose acetate, which is made by dry spinning using acetone as a solvent can also be utilized, but are less preferred. The polymers used in making the fibers are semi-crystalline, which means that they exhibit a melt endotherm when they are heated in a differential scanning calorimeter. The semi-crystalline polymer and the polymer used in the high modulus fibers can be the same polymer, as would be the case, for example, if high modulus polyethylene fiber or high modulus poly(ethylene naphthalate) fiber is combined with fibers made from the same polymer containing hard particles. Generally, however, the polymers are different.

Semi-crystalline melt-processable polymers that will be highly useful include poly(alkylene terephthalates), poly(alkylene naphthalates), poly(arylene sulfides), aliphatic and aliphatic-aromatic polyamides, polyesters comprising monomer units derived from cyclohexanedimethanol and terephthalic acid, and polyolefins, including polyethylene and polypropylene. Examples of specific semi-crystalline polymers include poly(ethylene terephthalate), poly(butylene terephthalate), poly(ethylene naphthalate), poly(phenylene sulfide), poly(1,4-cyclohexanedimethanol terephthalate), wherein the 1,4-cyclohexanedimethanol is a mixture of cis and trans isomers, nylon-6, nylon-66, polyethylene and polypropylene. These polymers are all known to be useful for making fibers. The preferred semi-crystalline polymers are poly(ethylene terephthalate), nylon 6 and nylon 66. The most preferred polymers are poly(ethylene terephthalate) (PET).

The hard particulate filler may be a metal, such as an elemental metal or metal alloy, or may be a nonmetallic compound derived from a metal (e.g. a metal oxide). Generally, any filler may be used that has a Mohs Hardness value of about 3 or more. Particularly suitable fillers have a Mohs Hardness value greater than about 4 and preferably greater than about 5. Iron, steel, tungsten and nickel are illustrative of metals and metal alloys, with tungsten, which has a Mohs value ranging from about 6.5 to 7.5 being preferred. Nonmetallic materials are also useful. These include, but are not limited to, metal oxides, such as aluminum oxide, silicon dioxide, and titanium dioxide, metal carbides, such as silicon carbide and tungsten carbide, metal nitrides, metal sulfides, metal silicates, metal silicides, metal sulfates, metal phosphates, and metal borides. Many of these are ceramic materials. Of the ceramics, aluminum oxide, and especially calcined aluminum oxide, is most preferred.

The particle size and particle size distribution are important parameters in providing good cut resistance to the yarn while preserving fiber mechanical properties Excessively large particles (greater than about 6 microns) are detrimental to the tensile properties of textile fibers, which have a denier in the range of about 1 to about 15 dpf. The particles may be in the form of powders, flat particles (i.e. platelets), or elongated particles, such as needles. The average particle diameter is generally in the range of about 0.25 to about 6 microns. Preferably the average particle diameter is in the range of about 1 to about 6 microns. The most preferred average particle diameter is in the range of about 1 to about 3 microns. For particles that are flat (i.e. platelets) or elongated, the particle diameter refers to the length along the long axis of the particle (i.e. the long dimension of an elongated particle or the average diameter of the face of a platelet).

The amount of hard filler is chosen to yield enhanced cut resistance in the yarn without causing a significant loss of tensile properties. Desirably, the cut resistance of a fabric made from a yarn comprising the particle-filled fiber will show improvements of at least about 20% in cut resistance using either the Ashland Cut Protection Performance Test or the BETATEC™ impact cam cut test. Preferably the cut resistance will improve by at least about 35%, and most preferably will improve by at least about 50% in comparison with a fabric made from yarns comprising the same polymers but without the hard particles. The tensile properties of the particle filled fiber (tenacity and modulus) preferably will not decrease by more than about 50%, and more preferably will not decrease by more than about 25%. Most preferably, there will not be a significant change in tensile properties (i.e., less than about 10% decrease in properties).

The filler generally will be present in the semi-crystalline polymer fiber in an amount of at least about 0.1% by weight. The upper limit of filler is determined mainly by the effect on tensile properties, but levels above about 10% by volume are generally less desirable. On a volume basis, the particle level concentration is generally in the range of about 0.1% to about 5% by volume, and preferably is in the range of about 0.5% to about 4% by volume. For the preferred embodiment (calcined alumina in PET), these ranges correspond to about 0.3% to about 14% by weight, and preferably about 1.4% to about 11% by weight.

In accordance with the present invention, the particle-filled fibers are prepared from a filled resin. The filled resin is made by any of the standard methods for adding a filler to a resin. For example, for a melt processable polymer, the filled resin is conveniently prepared in an extruder by mixing the hard filler with molten polymer under conditions sufficient to provide a uniform distribution of the filler in the resin, such as mixing in a twin screw extruder. The filler may also be present during the manufacture of the polymer or may be added as the polymer is fed into the extruder of fiber spinning equipment.

Since the filler is distributed uniformly in the polymer melt, the filler particles are also typically distributed uniformly throughout the fibers, except that elongated and flat particles are oriented to some extent because of the orientation forces during fiber spinning. Some migration of the particles to the surface of the fiber may also occur. Thus, while the distribution of particles in the fibers is described as "uniform", the word "uniform" should be understood to include non-uniformities that occur during the processing (e.g., melt spinning) of a uniform polymer blend. Such fibers in combination with high modulus fibers would still fall within the scope of this invention. Furthermore, the particle-filled polymer in the fiber may be part of a heterofil (i.e., one component in a multiple component fiber, such as a sheath-core fiber). Such fibers in combination with high modulus fibers also fall within the scope of the invention.

The particle-filled thermoplastic polymer is made into fibers and yarns by conventional fiber spinning processes, such as melt spinning or dry spinning. The preferred process is melt spinning. The filled polymer is made into a multifilament yarn suitable for use in textiles. This means that the individual filaments of the yarn are in the range of about 1 to about 15 dpf, preferably about 1 to about 5 dpf, which gives a good combination of comfort and flexibility.

The high modulus fibers also are utilized as multifilament yarns, with the size of the individual filaments being in the range of about 1 to about 15 dpf, and preferably about 1 to about 5 dpf.

The two kinds of yarn and any other optional yarns are combined to yield a cut resistant yarn having exceptionally high resistance to cutting. The two kinds of yarn (and optionally other yarns) can be intermingled into a single composite yarn by standard methods, such as the use of an air jet. Alternatively the yarns can be combined by various wrapping methods, such as wrapping the particle-filled yarn around a core of high modulus yarn, or by wrapping the high modulus yarn around a core of particle-filled yarn. Additional fibers or yarns (such as fine metal wire) can optionally also be included in the wraps or in the core in the wrapped configurations. Better results in terms of both cut resistance and comfort are obtained if the particle-filled yarn is wrapped around the high modulus yarn. Multiple wraps can also be used, such as two or three wraps of the particle-filled yarn around the core yarn, which consists of the high modulus yarn.

As stated above, composite yarns with the particle-filled thermoplastic fiber as the outer wrap are more comfortable. Even greater comfort can be achieved by wrapping a conventional textile fiber, such as PET or nylon, around the composite yarn made from the particle-filled fiber and the high modulus fiber. All of these variations in wrapping are readily modified for specific applications by practitioners in the art.

A wide variation in amounts of particle-filled fiber and high modulus fiber can be used to make composite yarns that have excellent cut resistance. Generally there should be at least about 5% by weight of each of the two kinds of fiber in the composite yarn. Thus, if no other fibers are present, the composite yarns will comprise about 5% to about 95% by weight of each kind of fiber. Other kinds of fiber can also be included, such as fine metal wire for even greater cut resistance, or conventional textile fibers, such as PET or nylon, for even greater comfort. Preferably, about 5% to about 40% by weight of the high modulus fiber and at least about 30% of the particle-filled fiber are used in making the composites.

Cut resistant fabric may be made using the yarns described above by using conventional methods, such as knitting or weaving, and conventional equipment. Nonwoven fabrics can also be made. Such fabric will have improved cut resistance in comparison with the same fabric made using the same yarns but without the hard particulate fillers. The cut resistance of the fabric will be improved by at least about 20% when measured using the Ashland Cut Protection Performance test or the BETATEC™ impact cam cut test. Preferably the cut resistance will improve by at least about 35%, and most preferably will improve by at least about 50%.

Cut-resistant apparel, such as gloves, may then be made from the cut-resistant fabric described above. For example, a cut-resistant safety glove designed for use in the food processing industries may be manufactured from the fabric. Such a glove is highly flexible. It is also readily laundered if the particle-filled fiber comprises PET and if the high modulus fiber is a liquid crystalline polymer or extended chain polyethylene, all of which are resistant to chlorine bleach.

The invention is further illustrated in the following nonlimiting examples.

EXAMPLES

Calcined aluminum oxide was compounded with poly(ethylene terephthalate) (PET) according to the following method. The aluminum oxide was obtained from Agsco Corporation 621 Route 46, Hasbrouck, N.J. The aluminum oxide was sold as Alumina #1, had an average particle size of about 2 microns, and was in the from of platelets. The alumina was compounded with PET in a twin screw extruder so that the compound contained about 6% by weight of alumina. The compound was then extruded and pelletized. The PET/alumina compound was melt spun by forcing the molten polymer first through a filter pack and then through a spinnerette. The yarn was drawn off a heated feed roll at 80° C. onto a draw roll at 180° C., and subsequently was wound onto a roll at room temperature with 2% relaxation. The yarn was then combined with yarns of either VECTRAN® liquid crystalline polymer fiber or CERTRAN® or SPECTRA® extended chain polyethylene fiber by wrapping the alumina filled PET around the high modulus fiber. Both VECTRAN HS and M were used, and they gave similar results. In some cases, an outer wrap of nylon or PET was wrapped around the outside of the yarn. Some of the test samples comprised comingled yarns rather than wrapped yarns. The yarn compositions used in these examples are reported in Table 1. The yarns were knitted into fabric so that the cut resistance could be measured. The areal density of the fabric was measured in ounces per square yard (OSY in the Table). The cut resistance of the fabric was measured using two tests.

(1) Ashland Cut Protection Performance ("CPP") test.

In the CPP test, the fabric sample is placed on the convex surface of a mandrel. A series of tests is carried out in which a razor blade loaded with a variable weight is pulled across the fabric until the fabric is cut all the way through. The distance the razor blade travels across the cloth until the blade cuts completely through the cloth is measured. The point at which the razor blade cuts through the fabric is the point at which electrical contact is made between the mandrel and razor blade. The logarithm of the distance required to make the cut is plotted on a graph as a function of the load on the razor blade. The data are measured and plotted for cut distances varying from 0.3 inches to about 1.8 inches. The resulting plot is approximately a straight line. An idealized straight line is drawn or calculated through the points on the plot, and the weight required to cut through the cloth after one inch of travel across the cloth is taken from the plot or calculated by regression analysis. This is referred to as the "CPP" value.

To decrease scatter in the test data, calibration tests were run before and after each series of CPP tests. A calibration standard with a known CPP value was used to correct the results of the series of tests. The calibration standard was 0.062 inch neoprene, style NS-5550, obtained from Fairprene, 85 Mill Plain Road, Fairfield, Conn. 06430, which has a CPP value of 400 gms. The CPP value was measured for this standard at the beginning and end of a series of tests, and an average normalization factor was calculated that would bring the measured CPP value of the standard to 400 gms. The normalization factor was then used to correct the measured data for that series of tests.

The CPP data are reported in Table 1. To help with comparisons of samples with different areal densities, the value of CPP was divided by the OSY. This is reported as CPP/OSY in the Table. This ratio is believed to be a fair approximation for comparison purposes as long as there is not a great deal of variation in the areal density.

(2) BETATEC™ Impact Cam Test. The method and apparatus are described in U.S. Pat. No. 4,864,852, hereby incorporated by reference. The test is known as the BETATEC impact cam cut test. The test involves repeatedly contacting a sample with a sharp edge that falls on the sample, which is rotating on a mandrel. These "chops" are repeated until the sample is penetrated by the cutting edge. The higher the number of cutting cycles (contacts) required to penetrate the sample, the higher the reported cut resistance of the sample. This test is a simulation of the kind of cutting accident that would occur with a knife that slips. During testing, the following conditions were used: 180 grams cutting weight, mandrel speed of 50 rpm, rotating steel mandrel diameter of 19 mm, cutting blade drop height of about ¾ inch, use of a single edged industrial razor blade for cutting, cutting arm distance from pivot point to center of blade about 15.2 cm (about 6 inches).

The results of the BETATEC impact cam test are reported in Table 1 along with the CPP test results.

It can be seen in Table 1 that the yarns containing particle-filled fiber and high modulus fiber give roughly the same values as the yarns containing a continuous length of fiberglass and a high modulus fiber as measured using the BETATEC test. This is surprising in view of the fact that the samples using particle-filled fiber in the yarn have considerably less hard material and less high modulus fiber than the composite yarns using continuous filaments of glass fiber.

It is to be understood that the above described embodiments of this invention are illustrative only and that modification throughout may occur to one skilled in the art. Accordingly, this invention is not to be regarded as limited to the embodiments disclosed herein.

Table 1

Cut Resistance of Fabrics Using Composite Yarns

| Example No. | Fiber Weight Fraction in Yarn[1] | | | | | | | | | | Weight Fraction[7] | | |
|---|---|---|---|---|---|---|---|---|---|---|---|---|---|
| | Filled Fiber[2] | Glass Fiber | VEC-TRAN Fiber | H.M.P.E. Fiber[9] | PET Clad-ding[4] | Nylon Clad-ding[4] | Fabric OSY[5] | CPP[8] | CPP/OSY | BETATEC[6] | Hard Com-ponent | High Modulus | Conven-tional Polymer |
| 1 | 0.42 | | | 0.58(C) | | | 21 | 1450 | 69 | | 0.025 | 0.58 | 0.40 |
| 2 | 0.71 | | 0.29 | | | | 18 | 1597 | 89 | 19 | 0.043 | 0.29 | 0.67 |
| 3 | 0.85 | | 0.15 | | | | 18 | 1257 | 70 | 16 | 0.051 | 0.15 | 0.80 |
| 4 | 0.78 | | | 0.22(C) | | | 19 | 1649 | 87 | 12 | 0.047 | 0.22 | 0.73 |
| 5 | 0.71 | | | 0.29(C) | | | 18 | 1631 | 91 | 11 | 0.043 | 0.29 | 0.67 |
| 6 | 0.48 | | | 0.38 | 0.14 | | 12 | 1128 | 94 | | 0.029 | 0.38 | 0.59 |
| 7 | 0.61 | | | 0.25 | 0.14 | | 14 | 1218 | 87 | 6 | 0.037 | 0.25 | 0.71 |
| 8 | 0.78 | | 0.22 | | | | 17 | 1472 | 87 | | 0.047 | 0.22 | 0.73 |
| 9 | 0.88 | | 0.12 | | | | 21 | 1515 | 72 | 26 | 0.053 | 0.12 | 0.83 |
| 10 | 0.79 | | 0.21 | | | | 12 | 1038 | 87 | 6 | 0.047 | 0.21 | 0.74 |
| 11 | 0.79 | | 0.21 | | | | 12 | 943 | 79 | 15 | 0.047 | 0.21 | 0.74 |
| 12 | 0.79 | | 0.21 | | | | 13 | 528 | 41 | 17 | 0.047 | 0.21 | 0.74 |
| 13 | 0.8 | | | 0.20(C) | | | 14 | 545 | 39 | 10 | 0.048 | 0.20 | 0.75 |
| 14 | | 0.23 | | 0.43 | | 0.34 | 12 | 1824 | 152 | 7 | 0.23 | 0.43 | 0.34 |
| 15 | | 0.35 | | 0.36 | 0.29 | | 26 | 4126 | 159 | 20 | 0.35 | 0.36 | 0.29 |
| 16 | | 0.39 | | 0.40 | | 0.21 | 19 | 3431 | 181 | 12 | 0.39 | 0.40 | 0.21 |
| 17 | 0.76[3] | | | 0.24(C) | | | 19 | 959 | 51 | 9 | 0.076 | 0.24 | 0.68 |

[1]Weight fraction of fiber components in yarn.
[2]Filled fiber is about 6% by weight alumina (about 2 micron particle size) in PET except Example No. 17, which uses tungsten.
[3]The hard filler is tungsten metal (about 10 weight %) (0.8 micron particle size)
[4]PET or nylon cladding is wrapped around the outside of the yarn.
[5]The weight of the fabric, measured in ounces/square yard.
[6]The average number of chops to cut through a sample using the BETATEC impact cam cut test.
[7]Composition according to types of materials in the composition. The amount of hard component is computed from the weight % of ceramic filler in the fiber, with the remainder of the filled fiber (the polymer) being referred to as "conventional" polymer. "Hard Component" includes glass fiber, alumina particles, and tungsten particles.
[8]Cut Protection Performance Test.
[9]High Modulus Polyethylene. The yarns with a "C" are CERTRAN fiber. The others are SPECTRA fiber.

We claim:

1. A cut resistant composite yarn comprising: (a) a high modulus fiber, said fiber having a modulus greater than 200 gpd as measured by ASTM Test Method D-3822, wherein said fiber is selected from the group consisting of aramid fiber, extended chain polyolefin fiber, thermotropic liquid crystalline fiber, high strength poly(vinyl alcohol) fiber, and poly(ethylene naphthalate) fiber, and (b) a particle-filled fiber, said fiber comprising a semi-crystalline polymer selected from the group consisting of poly(ethylene terephthalate), poly(butylene terephthalate), poly(ethylene naphthalate), poly(phenylene sulfide), poly(1,4-cyclohexanedimethanol terephthalate), nylon-6, nylon-66, polyethylene, and polypropylene and hard particles having a Mobs Hardness Value greater than 3 selected from the group consisting of tungsten metal particles and calcined aluminum oxide particles, where the average particle size is in the range of about 0.25 to about 6 microns, said particles being included in an amount less than 10% by volume.

2. A cut resistant composite yarn, as recited in claim 1, wherein said high modulus fiber is selected from the group consisting of aramid fibers, extended chain polyethylene fibers, and thermotropic liquid crystalline polymer fibers.

3. A cut resistant yarn as recited in claim 1, wherein said hard particles have a Mobs Hardness Value of at least 5.

4. A cut resistant yarn as recited in claim 1, wherein said hard particles have an average diameter in the range of about 1 to about 6 microns.

5. A cut resistant yarn as recited in claim 1, wherein said hard particles have an average diameter of about 1 to about 3 microns.

6. A cut resistant fiber as recited in claim 1, wherein said hard particles are included in amounts in the range of about 0.1% to about 5% on a volume basis.

7. A cut resistant yarn as recited in claim 1, wherein said hard particles are included in amounts in the range of about 0.5% to about 4% on a volume basis.

8. A cut resistant yarn as recited in claim 1, wherein said yarn comprises (a) a high modulus yarn which consists essentially of said high modulus fiber, and (b) a particle-filled yarn which consists essentially of said particle-filled fiber, where one of said yarns selected from the group consisting of said high modulus yarn and said particle-filled yarn is wrapped around the other of said yarns selected from the group consisting of said high modulus yarn and said particle filled yarn.

9. A cut resistant yarn as recited in claim 1, wherein said high modulus fiber and said particle-filled fiber each have a denier in the range of about 1 dpf to about 15 dpf.

10. A cut resistant yarn as recited in claim 1, wherein said high modulus fiber and said particle-filled fiber each have a denier in the range of about 1 dpf to about 5 dpf.

11. A cut resistant yarn as recited in claim 1, wherein said semi-crystalline polymer is poly(ethylene terephthalate).

* * * * *